United States Patent [19]

Rich et al.

[11] Patent Number: 5,070,849

[45] Date of Patent: Dec. 10, 1991

[54] MODULAR FUEL DELIVERY SYSTEM

[75] Inventors: Gregory E. Rich, Richmond; Donald J. Armstrong, Troy, both of Mich.

[73] Assignee: General Motors Corporation, Detroit, Mich.

[21] Appl. No.: 656,668

[22] Filed: Feb. 15, 1991

[51] Int. Cl.[5] ..... F04B 39/12

[52] U.S. Cl. ..... 123/509; 123/514; 137/565; 137/576

[58] Field of Search ..... 123/514, 509, 510, 497; 137/571, 574, 576, 565, 577; 417/360

[56] References Cited

U.S. PATENT DOCUMENTS

| | | | |
|---|---|---|---|
| 2,953,156 | 8/1957 | Bryant | 137/263 |
| 4,503,885 | 3/1985 | Hall | 137/576 |
| 4,546,750 | 10/1985 | Brunell et al. | 123/514 |
| 4,672,937 | 6/1987 | Fales | 123/509 |
| 4,694,857 | 9/1987 | Harris | 137/565 |
| 4,706,707 | 11/1987 | Betterton et al. | 137/565 |
| 4,747,388 | 5/1988 | Tuckey | 123/514 |
| 4,776,315 | 10/1988 | Greiner | 123/509 |
| 4,780,063 | 10/1988 | Tuckey | 137/565 |
| 4,807,582 | 2/1989 | Tuckey | 123/514 |
| 4,860,714 | 8/1989 | Bucci | 123/514 |
| 4,893,647 | 7/1990 | Tuckey | 137/576 |
| 4,928,657 | 5/1990 | Asselin | 123/514 |
| 4,971,017 | 11/1990 | Beakley | 123/514 |
| 4,974,570 | 12/1990 | Szwargulski | 123/509 |
| 5,016,670 | 5/1991 | Shsaki | 123/514 |
| 5,018,502 | 5/1991 | Humpl | 123/509 |

*Primary Examiner*—Carl Stuart Miller
*Attorney, Agent, or Firm*—Saul Schwartz

[57] ABSTRACT

A modular fuel delivery system including a reservoir in a fuel tank, an electric fuel pump in the reservoir, and a jet pump for pumping fuel from the fuel tank into the reservoir wherein overflow from the reservoir is recirculated by the jet pump back into the reservoir to minimize mixing of potentially hot overflow with cooler bulk fuel in the fuel tank. A recirculation fluid flow path extends from the reservoir to a secondary inlet of the jet pump adjacent a small diameter end of a venturi passage in the latter. A valve closes the recirculation flow path when the reservoir is not overflowing and opens the recirculation flow path when the reservoir is overflowing. A portion of the recirculation flow path is above the maximum surface elevation of fuel in the fuel tank so that the pressure head at the recirculation inlet exceeds the pressure head at the main inlet of the jet pump open to the fuel tank. Accordingly, when the recirculation flow path is open, the jet pump entrains fuel from the recirculation inlet in preference to fuel from the main inlet.

4 Claims, 1 Drawing Sheet

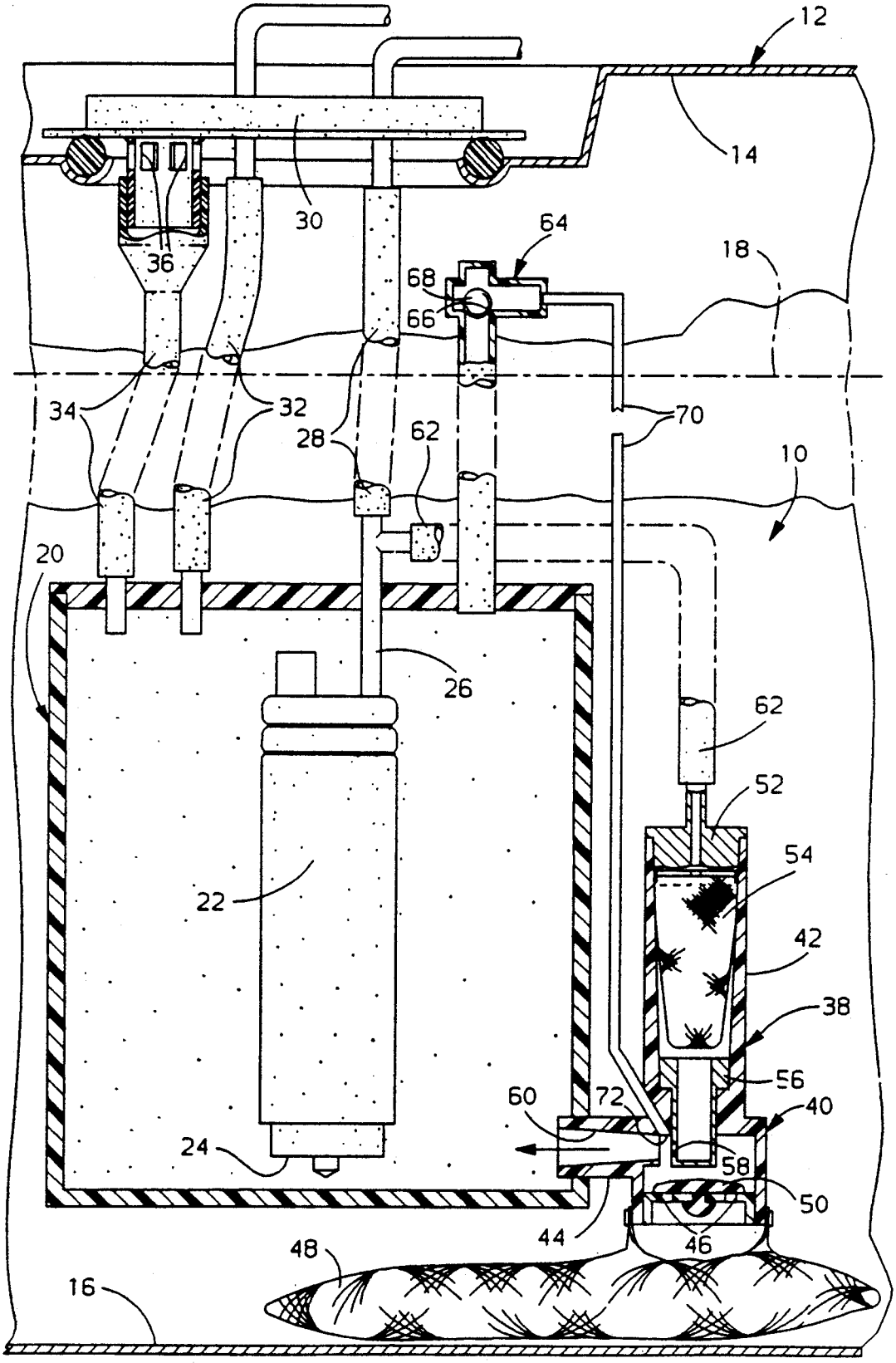
12
14
30
36
64
18
68
66
34
32
28
62
70
10
20
26
62
52
54
22
42
38
56
60
72
40
24
58
50
44
46
48
16

MODULAR FUEL DELIVERY SYSTEM

FIELD OF THE INVENTION

This invention relates to automobile fuel systems.

BACKGROUND OF THE INVENTION

An automotive modular fuel delivery system described in U.S. Pat. No. 4,945,884, issued 7 Aug. 1990 and assigned to the assignee of this invention, includes a reservoir in the fuel tank of the vehicle, an electric fuel pump in the reservoir, and a jet pump for pumping bulk fuel from the tank into the reservoir. A fraction of the high pressure output of the fuel pump is diverted to the jet pump as the energy source for the latter and the remainder is conducted to the engine of the vehicle. Fuel not consumed by the engine is returned, usually hot, to the reservoir. During a prolonged period of low engine fuel consumption, return fuel and jet pump discharge may overflow the reservoir through a vent or other opening between the reservoir and the fuel tank causing a mixing of hot return fuel and bulk fuel in the tank. A modular fuel delivery system according to this invention minimizes the likelihood of overflow from the reservoir into the bulk fuel in the fuel tank thereby to remove a bulk fuel heat source for the purpose of retarding vapor generation in the fuel tank.

SUMMARY OF THE INVENTION

This invention is a new and improved modular fuel delivery system of the type including a reservoir in a fuel tank, an electric fuel pump in the reservoir, and a secondary pump for filling the reservoir. The secondary pump, preferably a jet pump, has a main inlet open to the fuel tank and a recirculation inlet open to the reservoir through a recirculation conduit and a recirculation valve housing. The recirculation valve housing has an elevated float valve therein which blocks communictaion with the reservoir whenever the reservoir is less than overflowing. The elevation of the float valve assures that when the reservoir overflows, the fluid pressure head at the recirculation inlet exceeds the fluid pressure head at the main inlet so that the secondary pump draws preferentially from the recirculation inlet instead of from the main inlet and thereby recirculates reservoir overflow back into the reservoir and avoids overflowing hot retrun fuel into the bulk fuel in the fuel tank.

BRIEF DESCRIPTION OF THE DRAWING

The single drawing figure is a schematic elevational view, partly in cross section, of a modular fuel delivery system according to this invention.

DESCRIPTION OF A PREFERRED EMBODIMENT

Referring to the drawing figure, a modular fuel delivery system (10) according to this invention is disposed in a fragmentarily illustrated fuel tank (12) of an automobile. The fuel tank has an upper wall (14) and a lower wall (16). Bulk fuel in the tank (12) has a surface level (18) which varies from a maximum shown in the drawing figure when the tank is full to a minimum, not shown, substantially at the lower wall (16) when the tank is empty.

The modular fuel delivery system (10) includes a closed cylindrical reservoir (20) supported vertically in the fuel tank near the lower wall (16). An electric fuel pump (22) disposed in the reservoir has an inlet (24) at its lower end and a high pressure discharge (26) at its upper end. A representative electric fuel pump is described in U.S. Pat. No. 4,718,827, issued 12 Jan. 1988 and assigned to the assignee of this invention. A conventional wiring harness, not shown, turns the fuel pump (22) on when the ignition system of the vehicle is turned on.

A high pressure hose (28) connected to the fuel pump discharge (26) conducts high pressure fuel to an engine, not shown, through a cover (30) on the upper wall (14) of the fuel tank. A low pressure hose (32) connected to the reservoir (20) through the cover (30) returns fuel not consumed by the engine to the reservoir. Usually, the return fuel is hot due to its passage in close proximity to hot zones of the engine. A vertical vent hose (34) connected to the reservoir terminates near the cover (30) at a plurality of vent orifices (36). The orifices (36) provide communication between the reservoir and the vapor space located between the surface level of bulk fuel in the fuel tank and the upper wall (14).

A secondary pump of the modular fuel delivery system (10) in the form of a jet pump (38) pumps bulk fuel from the fuel tank (12) into the reservoir. While the jet pump (38) is illustrated outside the reservoir, it may also be inside the reservoir as described in U.S. patent application service number 07/531,737, filed 1 June 1990 and assigned to the assignee of this invention. The jet pump includes a housing (40) having a vertical stem (42) and a horizontal stem (44). A main inlet (46) of the jet pump (38) at the bottom of the housing (40) is open to bulk fuel in the fuel tank (12) through a screen (48) outside the reservoir. An umbrella-type check valve element (50) on the housing (40) at the main inlet (46) prevents backflow from the housing into the fuel tank.

The jet pump (38) further includes a connector (52) at the top of the vertical stem (42) and a screen (54) and a nozzle (56) inside the vertical stem. An orifice (58) in the nozzle (56) is aligned with the small diameter end of a venturi passage (60) in the horizontal stem (44) of the jet pump housing. A jet pump hose (62) between the high pressure discharge (26) and the connector (52) conducts a fraction of the high pressure discharge of the electric fuel pump (22) to the jet pump (38).

A hollow plastic recirculation valve housing (64) extends vertically from the top of the reservoir (20). The valve housing (64) has an internal valve seat (66) elevated above the maximum elevation achieved by the surface level (18) of the bulk fuel in the fuel tank. A schematically illustrated float (68) disposed in the housing (64) above the seat (66) has an open position, not shown, displaced vertically from the valve seat (66) and a closed position seated on the seat (66). A recirculation conduit (70) extends from the recirculation valve housing above the valve seat (66) to a recirculation inlet (72) in the jet pump housing (40) between the nozzle orifice (58) and the small diameter end of the venturi passage (60).

The modular fuel delivery system (10) operates as follows. When the ignition system of the vehicle is on, the electric fuel pump (22) pumps fuel from the reservoir (20) to the engine through the high pressure hose (28) and to the jet pump (38) through the jet pump hose (62). At the same time, hot fuel returns from the engine to the reservoir through the low pressure hose (32). In addition, the fraction of high pressure fuel directed to the jet pump exits as a high velocity jet from the orifice

(58) into the venturi passage (60). The high velocity jet entrains fuel from either the main inlet (46) or from the recirculation inlet (72) as described below and discharges the combined flow into the reservoir.

Normally, the rate at which the reservoir is pumped out and the rates at which it is replenished by hot fuel return and by jet pump discharge maintain the reservoir less than full. In that circumstance, the float (68) in the recirculation valve housing assumes its closed position seated on the seat (66). In the closed position of the float, communication between the recirculation inlet (72) in the jet pump housing and the reservoir is severed so that all fuel entrained by the high velocity jet from orifice (58) is bulk fuel from the fuel tank (12) entering the jet pump housing through the main inlet (46).

During prolonged periods minimal engine fuel consumption, hot fuel return from the engine may overflow the reservoir. In that circumstance, fuel rises in the recirculation valve housing and in the vent hose (34) above the top of the reservoir. Since the valve seat (66) is at a lower elevation then the vent orifice (36), the float (68) shifts to its open position before fuel overflows through the vent orifices (36) into the fuel tank. Fuel then fills the remainder of the recirculation valve housing (64) and is conducted by the recirculation conduit (70) to the recirculation inlet (72) in the jet pump housing.

Since the valve seat (66) is above the highest elevation achieved by the surface level of bulk fuel in the fuel tank, the fluid pressure head at the recirculation inlet (72) always, including when the fuel tank is full, exceeds the fluid pressure head at the main inlet (46) when the float (68) is in its open position. Accordingly, in the open position of the float corresponding to overflow of the reservoir, fuel is entrained by the high velocity jet issuing from the orifice (58) preferentially from the recirculation inlet (72) instead of from the main inlet (46). In a reservoir overflow situation, then, the jet pump recirculates fuel back into the reservoir to minimize the likelihood that hot fuel will overflow from the reservoir into the bulk fuel in the fuel tank.

We claim:

1. A modular fuel delivery system comprising:

a reservoir in a vehicle fuel tank, an electric fuel pump in said reservoir having a high pressure discharge and an inlet open to said reservoir so that said fuel pump pumps fuel exclusively from said reservoir, hose means for conducting fuel from said high pressure discharge to an engine and for conducting excess fuel at low pressure from said engine to said reservoir, a secondary pump having a discharge connected to said reservoir and a main inlet connected to said fuel tank, means for operating said secondary pump when said electric fuel pump is on whereby said secondary pump pumps fuel from said fuel tank into said reservoir, means defining a recirculation inlet in said secondary pump, means defining a recirculation fluid flow path from said reservoir to said recirculation inlet operative to conduct overflow from said reservoir to said recirculation inlet, a recirculation valve operative to sever communication between said reservoir and said recirculation inlet through said recirculation fluid flow path when said reservoir is not overflowing, and means operative when said reservoir overflows and said recirculation fluid flow path is open to effect pumping by said secondary pump of fuel from said recirculation inlet in preference to fuel from said main inlet so that said secondary pump recirculates overflow from said reservoir back into said reservoir.

2. The modular fuel delivery system recited in claim 1 wherein said secondary pump is a jet pump having a nozzle orifice from which issues a high velocity jet of fuel when said electric fuel pump is on, and a venturi passage receiving said high velocity jet of fuel from said nozzle orifice and having a small diameter end in spaced relation to said nozzle orifice.

3. The modular fuel delivery system recited in claim 2 wherein said recirculation inlet in said secondary pump is located between said nozzle orifice and said small diameter end of said venturi passage, and said means operative when said reservoir overflows and said recirculation fluid flow path is open to effect pumping by said secondary pump of fuel from said recirculation inlet in preference to fuel from said main inlet includes means for increasing the fluid pressure head at said recirculation inlet to a magnitude above the fluid pressure head at said main inlet.

4. A modular fuel delivery system comprising:

a reservoir in a vehicle fuel tank, an electric fuel pump in said reservoir having a high pressure discharge and an inlet open to said reservoir so that said fuel pump pumps fuel exclusively from said reservoir, hose means for conducting fuel from said high pressure discharge to an engine and for conducting excess fuel at low pressure from said engine to said reservoir, a jet pump having a nozzle orifice from which issues a high velocity jet of fuel when said electric fuel pump is on and a venturi passage receiving said high velocity jet of fuel from said nozzle orifice and having a large diameter end in said reservoir and a small diameter end in spaced relation to said nozzle orifice, a recirculation valve housing connected to said reservoir and having a valve seat therein at an elevation above the maximum surface elevation of fuel in said fuel tank outside of said reservoir, a recirculation inlet in said jet pump located between said nozzle orifice and said small diameter end of said venturi passage, a recirculation conduit connected to said recirculation valve housing above said valve seat therein and to said recirculation inlet and through which a recirculation fluid flow path from said reservoir to said recirculation inlet is defined, a valve in said recirculation valve housing having a closed position on said valve seat severing said recirculation fluid flow path and an open position opening said recirculation fluid flow path, and means operative to maintain said valve in said closed position when said reservoir is not overflowing and to move said valve to said open when said valve is overflowing, the fluid pressure head at said jet pump recirculation inlet exceeding the fluid pressure head at said jet pump main inlet when said valve is in said open position so that said high velocity jet issuing from said jet pump nozzle entrains fuel from said recirculation inlet in preference to fuel from said main inlet and thereby recirculates overflow from said reservoir back into said reservoir.

* * * * *